United States Patent [19]

Pastore

[11] 4,018,120

[45] Apr. 19, 1977

[54] STOP ATTACHMENT FOR MAT CUTTING DEVICE

[76] Inventor: John B. Pastore, 34 Fox Ridge Crescent, Warwick, R.I. 02886

[22] Filed: Apr. 15, 1976

[21] Appl. No.: 677,312

[52] U.S. Cl. ..... 83/529; 83/530; 83/455; 83/486; 83/468

[51] Int. Cl.[2] ..... B26D 5/10; B26D 7/26

[58] Field of Search ..... 83/486, 455, 468, 522, 83/529, 530, 581, 486, 486.1

[56] References Cited

UNITED STATES PATENTS

| | | | |
|---|---|---|---|
| 1,013,010 | 12/1911 | Graham | 83/468 X |
| 3,779,119 | 12/1973 | Broides | 83/581 |
| 3,967,519 | 7/1976 | Esterly | 83/455 |

*Primary Examiner*—Willie G. Abercrombie
*Attorney, Agent, or Firm*—Barlow & Barlow

[57] ABSTRACT

A mat cutting device having a cutter carriage with tracks to guide the carriage in two right-angularly related directions with stops on the tracks to limit the movement of the carriage and removable attachments for the stops primary to change the limits that the stops would otherwise provide without moving the stops.

5 Claims, 4 Drawing Figures

STOP ATTACHMENT FOR MAT CUTTING DEVICE

BACKGROUND OF THE INVENTION

Heretofore there has been cutting boards with tracks to guide the movement of a carriage carrying a cutter as seen in U.S. Pat. Nos. 3,213,736 and 3,967,519. These tracks usually are at right angles to each other and the cutter carriage is movable between stops which are located on the tracks. In many cases the frame formed from a mat to be cut is in two plies with one of the openings formed in the mat of a slightly different size than the other so that looking through one mat, the other mat will be seen. Usually in order to obtain this result on the two mats the stops on the tracks have to be moved after one mat has been cut in order to make the second mat with a cut of a different size. Much inaccuracy occurs because of this movement of stops and the reading of the size relationship on the device, and an object of this invention is to provide a means to eliminate the inaccuracy caused by the re-setting of the stops for the carriage carrying the cutter.

SUMMARY OF THE INVENTION

This invention comprises the formation of a removable second stop means to clip onto the primary stops of the ordinary cutting device which attachments will be preformed of a certain desired dimension such, for instance, as a quarter of an inch, half inch, and so forth, and when these are clipped onto the ordinary primary stops, the stops do not have to be changed, thus providing a faster and more accurate limitation of the carriage which has a cutter attached thereto.

DESCRIPTION OF THE PREFERRED EMBODIMENT

Figure 1:
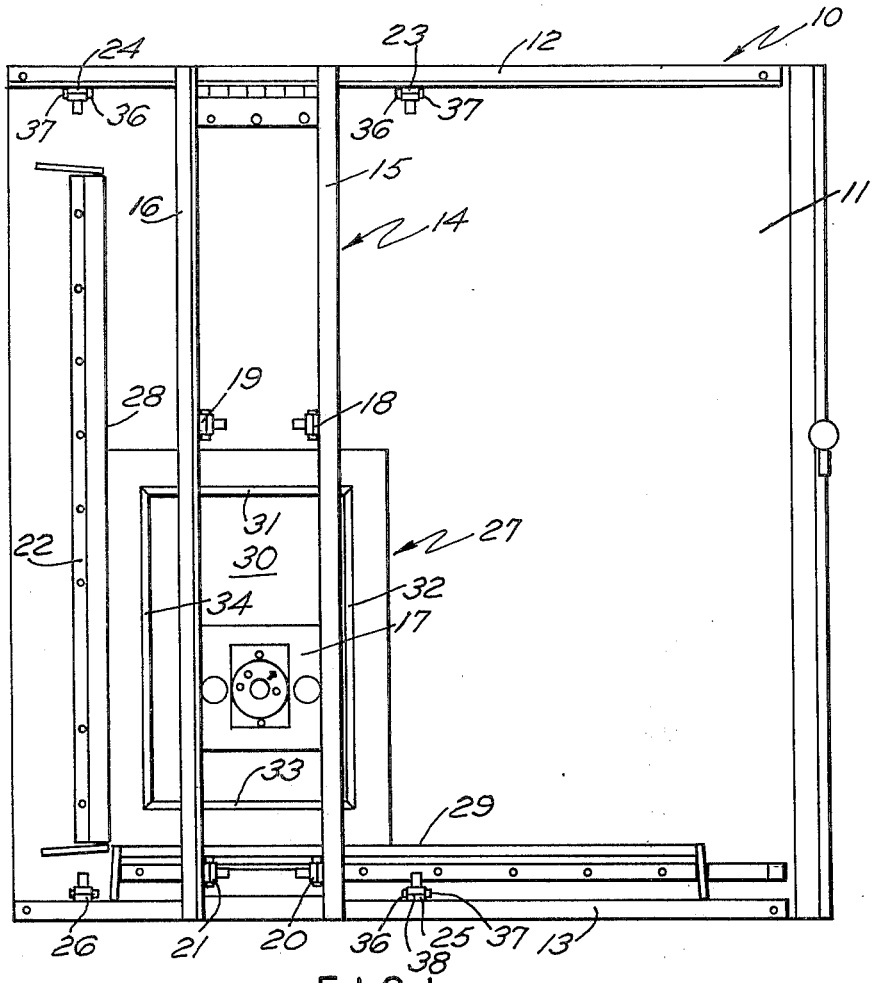
FIG. 1 is a plan view of the cutting device showing stops on the tracks thereof and my attachments on the stops.

In FIG. 1 the cutting device is shown generally at 10 and is provided with a plane surface 11 having opposite tracks 12 and 13 at its top and bottom edges to mount an assembly 14 of vertical tracks 15 and 16. These vertical tracks 15 and 16 serve to guide in a vertical path the carriage 17 which carries the cutter and is movable between these tracks up to the limits of stops 18, 19 for an upward movement and 20, 21 for a lower movement. They may be set in accordance with a scale at 22 vertically arranged at the left of the tracks and against which the mat 27 may be placed. The vertical track assembly 14 itself is mounted for horizontal movement in the tracks 12 and 13 and is limited by stops 23 and 24 along the upper track 12 and stops 25 and 26 along the lower track 13. The mat to be cut is designated generally 27 which may engage the straight edge 28 along the left side of the device where the scale 22 is located and the straight edge 29 parallel to the lower track 13 to position the mat as desired. The primary stops 18, 19, 20, 21, 23, 24, 25 and 26 are set in accordance with the opening 30 which is to be cut in the mat so that one may start at the upper lefthand corner placing the cutter into the mat and usually at an angle of 45° to the plane surface 11 and then moving the assembly 14 to the right to cut the beveled edge 31. Then when the stop 23 and 25 is engaged the cut along the beveled edge 32 will be made to the lower right-hand corner, then the cut to provide the beveled edge 33 and finally the beveled edge 34, each cut being made the distance allowed by movement of the carriage the length that it may be moved between the stops which are provided.

Figure 3:
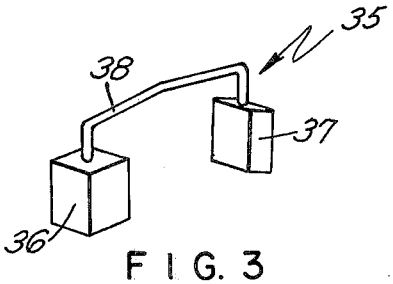
FIG. 3 is a perspective view of the attachment alone.

Assuming that the cuts just described have been made in the mat 27 with the stops as they come on the machine and it is desired to make a cut in another mat which cut is of slightly smaller size than the opening 30, then there will be positioned on each of the stops an attachment or second stop means shown in perspective in FIG. 3 and designated 35. This attachment has precise blocks 36 of one dimension and 37 of another dimension, and it we consider that the block 36 is of a half inch wide, this may be then clipped upon the stops with the block 36 on the side nearest the frame, there being one attachment for each of the eight stops, and then a second mat will be positioned and the procedure will be repeated causing the assembly to move from the upper lefthand corner to the right to engage the block 36 of the stop 23 with the attachment on it, then proceeding downwardly then to the left and upwardly to complete an opening in the second mat which will be of a size half inch on each side less than the previous cut 30 and in this case would be in a total of half an inch on each side less or a total of one inch less in dimension. If the dimension was to be a quarter of an inch less then the block 37 would be positioned on the inside of each of the stops and the attachment 35 would be in effect reversed.

Figure 2:
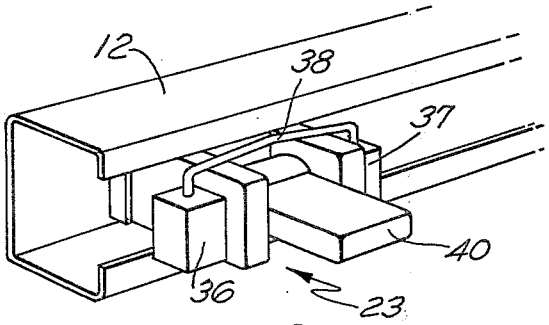
FIG. 2 is a perspective view on a larger scale illustrating one of the stops of the device with my second stop attachment in position.

A resilient wire 38 connects the two blocks 36 and 37 so that they may be sprung into position on the stop such as 23 or any of the stops as shown more particularly in FIG. 2. It will be understood that each of the stops 23 etc. are slidable along the track in which it is located and has a toggle or spring arrangement operably by the swinging of the lever 40 from either horizontal position in FIG. 2 to vertical position so that it will lock in one of these positions but may be moved by throwing the lever 40 to a right angular position to release it.

Figure 4:
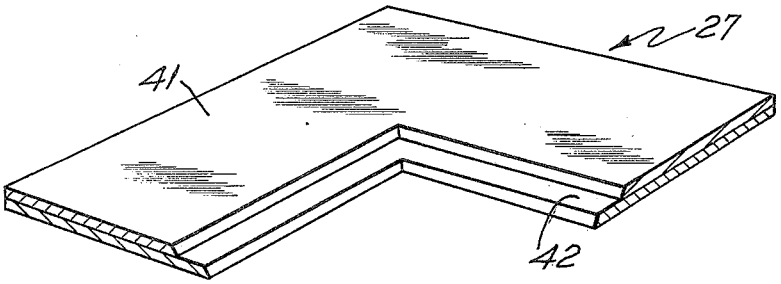
FIG. 4 is a fragmental perspective view of a corner of two mats superimposed one on another with different size center openings.

In FIG. 4 mats having differing size openings illustrated in which the larger opening is in the upper mat 41 and the smaller opening is in the lower mat 42 each being provided with the beveled surfaces customary in such mats.

I claim:

1. In a mat cutting device wherein plural sheets are to be cut to provide different size openings in each sheet, said device comprising a cutter carriage, means to guide the carriage, primary stop means to be engaged by the carriage to limit the movement of the carriage along said means to enable a first sized opening to be cut, second stop means removably mounted on said primary stop means to change the stop position of the carriage whereby a second sheet may be cut with finite dimensional difference.

2. In a mat cutting device as in claim 1 said second stop means including resilient means to clip on to said primary stop means.

3. In a mat cutting device as in claim 1 said second stop means having spaced blocks with a resilient connection between them to clip on to said primary stop means.

4. In a mat cutting device as in claim 1 said second stop means having spaced blocks of different sizes with a resilient connection between them to clip on to said primary stop means.

5. In a mat cutting device as in claim 1 said second stop means having spaced blocks with resilient wire between them to clip on to said primary stop means.

* * * * *